US007473050B2

(12) United States Patent
Liu et al.

(10) Patent No.: US 7,473,050 B2
(45) Date of Patent: Jan. 6, 2009

(54) SINGLE-LAYER INTERCHANGE OVERPASS

(76) Inventors: Yingtang Liu, 1-1, 10th Block, No. 98, Jule Road, Wuhuo District, Chengdu (CN) 610081; Xingliang Liu, 10th Block, No. 89, Section 1, Jiefang Road, Chengdu (CN) 610081

( * ) Notice: Subject to any disclaimer, the term of this patent is extended or adjusted under 35 U.S.C. 154(b) by 322 days.

(21) Appl. No.: 10/598,317

(22) PCT Filed: Aug. 25, 2004

(86) PCT No.: PCT/CN2004/000983

§ 371 (c)(1),
(2), (4) Date: Aug. 24, 2006

(87) PCT Pub. No.: WO2005/019534

PCT Pub. Date: Mar. 3, 2005

(65) Prior Publication Data

US 2008/0152426 A1 Jun. 26, 2008

(30) Foreign Application Priority Data

Aug. 25, 2003 (CN) ..... 03 1 35662

(51) Int. Cl.
*E01C 1/04* (2006.01)

(52) U.S. Cl. ..... 404/1

(58) Field of Classification Search ..... 404/1
See application file for complete search history.

(56) References Cited

U.S. PATENT DOCUMENTS

| | | | | | |
|---|---|---|---|---|---|
| 3,238,854 | A * | 3/1966 | Okubo | ..... | 404/1 |
| 4,272,210 | A * | 6/1981 | Shoji et al. | ..... | 404/1 |
| 4,592,673 | A * | 6/1986 | Lee | ..... | 404/1 |
| 5,520,478 | A * | 5/1996 | Yin-Lung | ..... | 404/1 |
| 7,234,891 | B2 * | 6/2007 | Niiya et al. | ..... | 404/1 |

FOREIGN PATENT DOCUMENTS

| | | | |
|---|---|---|---|
| DE | 101 08 865 | * | 9/2002 |
| FR | 2 613 392 | * | 10/1988 |
| WO | 2005/010278 | * | 3/2005 |

* cited by examiner

*Primary Examiner*—Gary S Hartmann
(74) *Attorney, Agent, or Firm*—Matthias Scholl P.C.; Matthias Scholl

(57) ABSTRACT

This invention discloses a single layer interchange overpass. The overpass comprises a main road (1) and an intersected road (3), a U-shaped circle road (24) is disposed at a predetermined level above both ends of the main road (1), an inner circle road (4) and an outer circle road (5) are disposed at the exit of each U-shaped circle road (24), a common ramp (7) is located between the inner and the outer circle roads (4, 5), the common ramp (7) is joined with an on-ramp of the intersected road (3) via the outer circle road (5); and an off-ramp of the intersected road (3) is joined with an on-ramp of the main road (1) via the inner circle road (4).

17 Claims, 4 Drawing Sheets

SINGLE-LAYER INTERCHANGE OVERPASS

CROSS-REFERENCE TO RELATED APPLICATIONS

This is a National Stage Application of International Patent Application No. PCT/CN 2004/000983, with an international filing date of Aug. 25, 2004, which is based on Chinese Patent Application No. 03135662.1, filed Aug. 25, 2003.The contents of both of these specifications are incorporated herein by reference.

TECHNICAL FIELD

The invention relates to an overpass, and especially an interchange overpass suitable for city roads and highways.

BACKGROUND

In order to solve traffic jams at city intersections many types of overpasses have been employed. Generally, triple level and higher grade overpass intersections are built for channeling motor and non-motor vehicles and for enabling transfer without impact and interference. Such high grade overpasses with their extra long ramps inconvenience drivers and occupy too much space. Especially in cities where much repositioning has to be done, the compensation cost for relocation of residents may be high. Providing clover-type overpasses will cause traffic jams in case of increased vehicle flow due to entanglement between the turning vehicles and the circling vehicles.

SUMMARY OF THE INVENTION

The invention provides a single-level interchange overpass having simple construction and full functionality, and occupying less space.

The technical solution of the invention is as follows: a single-level interchange overpass according to this invention comprises a main road and an intersected road, wherein a U-shaped circle road is provided on the horizontal level at both ends of the main road, a inner semicircle road and a outer semicircle road are provided at an exit of the said U-shaped circle road, a common road is provided between the inner semicircle road and the outer semicircle road, the common road is connected to an on-ramp of the intersected road through the outer semicircle road, and an off-ramp of the intersected road is connected to the on-ramp of the main road through the inner semicircle road.

In the above-described technical solution, an arched separated bridge is provided on the main road of the single layer interchange overpass, semi-ramped overhead bridge stages are provided on the intersected road on both sides of the arched separated bridge, the said semi-ramped overhead bridges stages are connected with the arched separated bridge through a connection platform, U-shaped circle roads are provided on the horizontal level at both ends of the arched separated bridge, the arcuate end of the outer semicircle road and the inner semicircle road is connected to the U-shaped circle road, the other end of the outer semicircle road and inner semicircle road of the U-shaped circle road is connected to the connection platform, a branch common road is provided on the off-ramp of the arched separated bridge of the main road, the other end of the common road is connected to the connection platform, a right turn road is provided at the entrance of the upper and lower U-shaped circle roads, and the other end of the right turn road is connected to the on-ramp of the arched separated bridge.

In the technical solution of this invention, in the single layer interchange overpass, the main road can be a leveled driveway, and the intersected road can be an overhead bridge, the U-shaped circle road comprises the inner semicircle road and the outer semicircle road, the common road is connected with the entrance of the outer semicircle road of the U-shaped circle road on other side of the overhead bridge after passing through under the overhead bridge, and the inner semicircle road is connected to the on-ramp of the main road through the left turn driveway.

The effects of the invention are as follows:

Reduction of the traditional 3 or 4 layer overpass to a single layer overpass allowing for transfer of vehicles from different directions and for separation of the motor and non-motor vehicles without inference. Pedestrians can walk on the original road eliminating the need to pass through tunnels or pedestrian overpasses. Reduction of the number of layers in the structures leads to an economic benefit.

The ramp of the overpass is slow which provides significant advantages of energy saving, noise reduction and wasteful exhaust reduction.

The compact construction occupies less space, producing high efficiency ramps, while low height of the construction facilities reduction in costs, environmental protection, and improved aesthetic sense.

Figure 1:
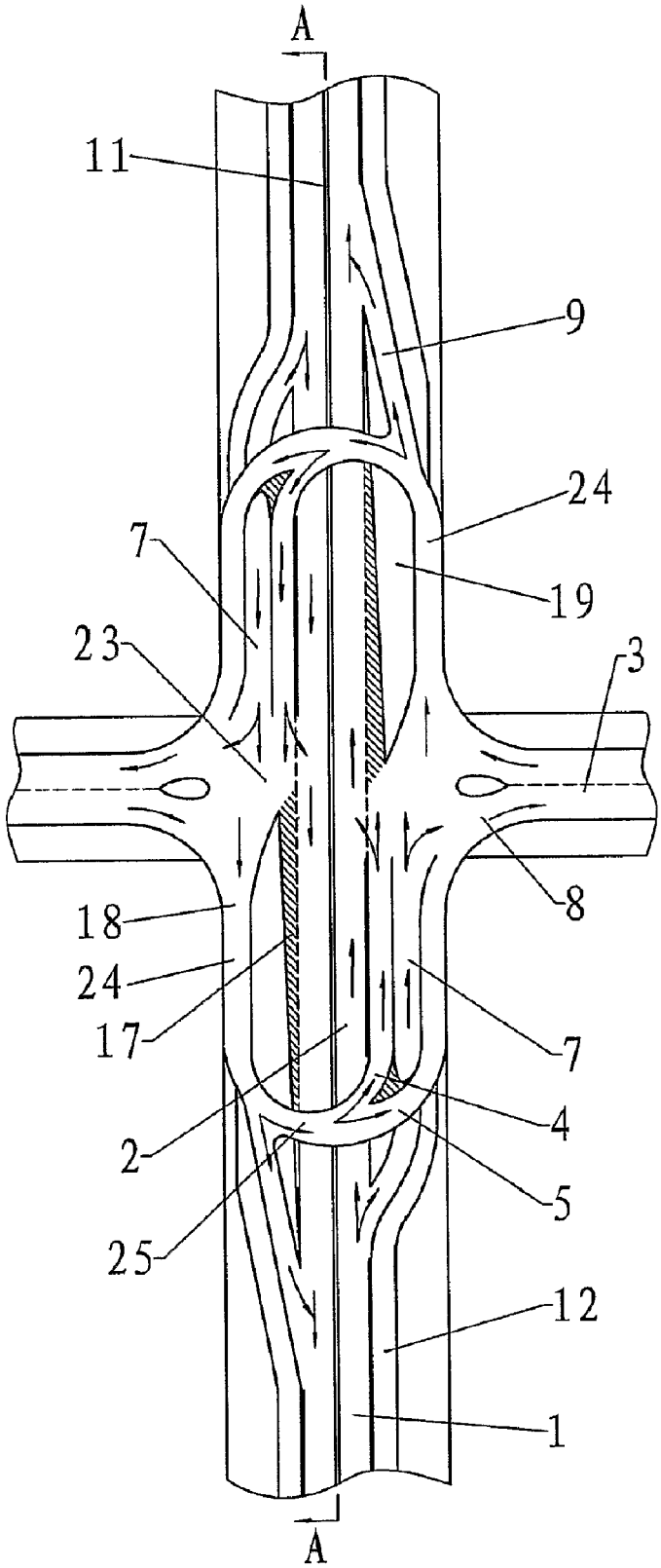
FIG. 1 is a plan view and directional scheme of one embodiment of the invention.

In the FIGS: 1—main road, 2—arched separated bridge, 3—intersected road, 4—inner semi-circular road, 5—outer semi-circular road, 6—underpass tunnel, 7—common road, 8—semi-ramped overhead bridge, 9—right on-ramp, 11—bidirectional median, 12—non-motor vehicle road, 13—secondary road, 14—left turning circle road, 17—convergent secondary road, 18—U-shaped circle road entrance, 19—ventilating window, 23—connection platform, 24—U-shaped circle road, 25—arcuate end, 26—U-turn median, 27—straight transition road, 28—U-turn road, 29—overhead bridge, 30—left turn branch lane, 31—right turn branch lane, 32—right turn road, 33—outer pass way.

DETAILED DESCRIPTION

Conventional circle-type intersections are associated with traffic jams caused by the entanglement and interference between vehicles making turns and vehicles circling on the overpasses. In order to solve this problem, in the overpass of the invention an outer semicircle road 5 and an inner semicircle road 4 are provided on the U-shaped circle road 24 on the upper side of the main road 1 to channel the turning vehicles and the straight-going vehicles. At the same time a common road 7 is provided between the outer semicircle road 5 and the inner semicircle road 4 to prevent the vehicles on the U-shaped circle road 24 from interfering.

The invention will now be described in detail in accordance with the drawings. In the embodiments the terms “left” and “right” refer to the travel direction of the vehicles, and the terms "upper" "lower" "left" and "right" refer to the orientation of the overpasses. With the overpass forming a base for an off-ramp and an on-ramp, the road entering the overpass is the off-ramp and the road exiting the overpass is the on-ramp.

EXAMPLE 1

As shown is FIG. 1, an overpass is provided at an intersection. The intersection is divided into the upper, lower, left, and right roads in which the main road 1 accommodates vehicle flow in the upper and lower direction, and the intersected road 3 accommodates vehicle flow in the left and right direction. The four roads of the overpass are leveled with the driveway's surface and are connected therewith. The straight main road 1 on the overpass is the arched separated bridge 2 which has the highest height at a position where the main road 1 intersects the intersected road 3. There is a ramp extending from the highest point of the arched separated bridge 2 down the upper and lower direction to connect it in the direction of the main road 1. The semi-ramped overhead bridge stages 8 are provided at the left and the right of the intersected road 3 at both sides of the arched separated bridge 2. One end of the semi-ramped overhead bridge stage 8 is connected with the arched separated bridge 2 at the same level and forms a connection platform 23, and the other end is connected with the driveway in left and right directions, i.e., in the direction of the intersected road 3. The arched separated bridge 2 and the semi-ramped overhead bridge stage 8 are provided with bidirectional driveways having off-ramps and on-ramps. The U-shaped circle road 24 which is leveled with the connection platform 23 is provided at a height of the upper and lower direction ramps of the arched separated bridge 2. The U-shaped circle road 24 comprises entrances 18 and exits connected with the left connection platform 23 and the right connection platform 23, respectively, and also the arcuate end 25 between the entrance 18 and the exit. The exit comprise an inner semi-circle road 4 in proximity to the interior of the main road 1 and an outer semi-circle road 5 positioned on the outer side of the main road 1. The arcuate end 25 of the U-shaped circle road 24 is higher with respect to the ramp of the arched separated bridge 2. The other end of the entrance 18 and the exit of the U-shaped circle road 24 are connected with the connection platform 23 of the left and right semi-ramped overhead bridge stage 8, respectively. A closed-circle road is formed after connecting the upper and lower U-shaped circle roads through the connection platform 23. The shape of the circle road is similar to that of the racetrack in a stadium. The unidirectional driveway running anticlockwise is used in the above-referenced circle road.

On the inner side of the outer semicircle road 5 of the upper and lower U-shaped circle road 24, i.e., between the arched bridges 2 and the outer semicircle road 5, an inner semicircle road 4 is provided. One end of the inner semicircle road 4 is connected with the arcuate end 25 of the U-shaped circle road and the other end is connected with the connection platform 23 of the arched separated bridge 2.

A branch common road 7 is provided as the off-ramp of the arched separated bridge 2 of the main road 1. The above-referenced common road 7 connects the road surface of the main road 1 with the connection platform 23 or the ramp of the arched separated bridge 2 after passing vertically under the accurate end 25 of the U-shaped circle road 24. The connector of the common road 7 and the connection platform 23 is located between the connectors of the inner semicircle road 4 and the outer semicircle road 5 and the connection platform 23, respectively. The inclusion of common road 7 effectively ensures the traveling of vehicles on the connection platform 23 and the U-shaped circle road 24 without interference.

The right on-ramp 9 is provided at the entrance 18 of the upper and lower U-shaped circle road 24 i.e. the right side of the upper U-shaped circle road 24 and the left side of the lower U-shaped circle road 24. The other end of the right on-ramp 9 is connected with the on-ramp of the arched separated bridge 2.

As shown in FIG. 1, due to the design of overhead arched separated bridge 2 and the semi-ramped overhead bridge stage 8, the non-motor vehicle road 12 for bicycles and pedestrians is provided under the overpass. The non-inference with motor vehicles in the areas of the existing intersections fully satisfies the condition of transfer of the pedestrians and bicycles. Therefore the inconvenience that would be caused by construction of the underground passage way is eliminated. In order to improve the illumination under the overpass, ventilation windows 19 passing through the surface of the overpass are formed at the connection platform 23 of the overpass.

Below the traveling directions of the vehicles on the overpass are explained with reference to arrows indicating the traveling directions in FIG. 1. (1) Straight ahead from lower to upper side: vehicles pass over the overpass along the right entrance of the bidirectional driveway in the lower main road 1 through the arched separated bridge 2 straight ahead from the lower side under the arcuate part 25 of the U-shaped circle road 24 through to the on-ramp of the upper main road 1. (2) Straight ahead from left to right: vehicles travel to the left connection platform 23 after entering the left semi-ramped overhead bridge stage 8 from the on-ramp of the bidirectional driveway in the left intersected road 3, and then enter the connection platform 23, turn right entering the entrance 18 of the outer U-shaped circle road 24, again enter the right connection platform 23 from outer semi-circle or road 5 of the lower U-shaped circle road 24 along the arcuate part 25 of the lower U-shaped circle road 24; then turn right and travel across the overpass entering the right off-ramp of the intersected roads from the right semi-ramped over head bridge stage 8, completing the straight way on the intersected roads via a zigzag manner instead of straight manner. (3) Turn from the lower main road 1 onto the right interested road 3: vehicles enter the right common road 7 through the entrance of the bidirectional driveway along the lower main road 1, and from the common road 7 enter the right connection platform 23, and then turn right entering the right semi-ramped over head bridge stage 8 continuing onto the on-ramp of the right intersected road 3 and passing through the overpass. (4) Turn from the lower main road 1 onto the left intersected road 3: vehicles enter the right common road 7 through the entrance of the bidirectional driveway along the lower main road 1, and from the common road 7 enter the right connection platform 23, and then continue straight up to the upper U-shaped circle road 24, turning around into the left connection platform 23 along the upper outer semicircle road 5, and then turn right entering the right semi-ramped over head bridge stage 8 continuing onto the on-ramp of the left intersected road 3 and passing through the overpass.(5) Turn from the left intersected road 3 into the lower main road 1: after entering the semi-ramped overhead bridge stage 8 from the entrance of the bidirectional driveway in the left intersected road 3 vehicles enter the connection platform 23, and then turn right into the lower U-shaped circle road 24, enter the on-ramp of the lower main road of the right on-ramp 9 which is connected with the lower U-shaped circle road 24, and so pass through the overpass. (6) Turn from the left intersected road 3 onto the upper main road 1: after entering the semi-ramped overhead bridge stage 8 through the entrance of the bidirectional driveway in the left intersected road 3 the vehicles enter the connection platform 23, turn right into the lower U-shaped circle road 24, and then enter the right connection platform 23 from the inner semi-circular road 4 of the lower U-shaped circle road 24 along the arcuate part 25 of the lower U-shaped circle road 24, and enter the on-ramp of the upper arched separated bridge 2 by merging left on the right connection platform 23, and then pass through the overpass from the on-ramp of the upper arched separated bridge 2 accomplishing the convergence into the main road without interference with the convergent secondary road 17, and pass through the overpass from the on-ramp of the upper arched separated bridge 2. (7) Return to the lower main road 1 from the lower main road 1: The vehicles enter the right common road 7 along the entrance of the bidirectional driveway in the lower main road 1, and enter the right connection platform 23 from the common road 7, straightway to the upper U-shaped circle road 24, then enter the left connection platform 23 passing around the inner semicircle road 4 of the upper U-shaped circle road 24 along the upper U-shaped circle road 24, and then enter the left connection platform 23 into the on-ramp of the lower arched separated bridge 2 by merging left off of the left connection platform 23, turning back to the on-ramp of the lower main road 1 from the on-ramp of the lower arched separated bridge 2. (8) Return to the left intersected road 3 from the left intersected road 3: after entering the semi-ramped overhead bridge stage 8 from the entrance of the bidirectional driveway in the left intersected road 3 the vehicles enter the connection platform 23 and turn right into the lower part of connection platform 23, then turn around into the inner semi circle road 4 of the lower U-shaped circle road 24 along the lower U-shaped circle road 24, and then enter the right connection platform 23, and then enter the upper U-shaped circle road 24 by bearing right on the right connection platform 23, then enter the left connection platform 23 from the outer semi circle road 5 of the upper U-shaped circle road 24, along the arcuate part 25 of the upper U-shaped circle road 24, then turn right to enter the right on-ramp of the left intersected road 3 from the left semi-ramped overhead bridge stage 8, thus accomplishing the turnaround.

From the foregoing it is clear that that the height of the overpass of the invention is reduced compared with the typical multilayer overpass, and also the occupied ground area and ramp size have been reduced. Compared with the clover-like overpass there is no interference on the main roads which facilities turning of the vehicles on the overpass in left and right direction and turning back.

Because the overpass of the invention is of single layer, not including the ground, therefore the height from the ground is limited only by the U-shaped circle road and generally is about 5 meters of clearance.

In order to increase the driving safety, the double solid line or the bidirectional median 11 between the bidirectional driveways is used to separate the driveways in two directions. In the case of driving to the on-ramp of the arched separated bridge 2 from the inner semicircle road 4 through the connection platform 23, a convergent secondary road 17 is provided at the right side of the on-ramp of the arched separated bridge 2 for avoiding accidents caused by the abrupt entering of vehicles.

In this embodiment, vehicles are assumed to drive on the right side of the road; for other countries or regions where vehicles travel on the left side of the road, arrangement of the driveways on the overpass can be changed accordingly, and this is also contemplated by the invention.

EXAMPLE 2

Figure 2:
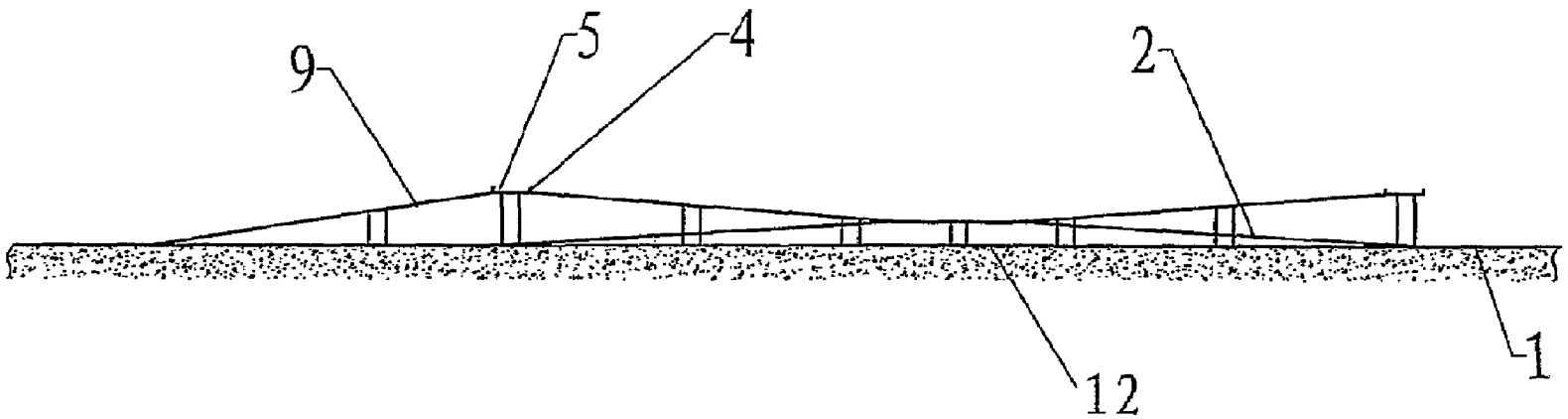
FIG. 2 is a cross-sectional view along the line A-A of FIG. 1.

The U-shaped circle road 24 is relatively long because the ramp length of the arched separated bridge 2 must satisfy the regulation of the ramp of the driveway and ensure clearance between the arcuate part 25 of the U-shaped circle road 24 and the arched separated bridge 2. As shown in FIG. 2, in order to shorten the length of the U-shaped circle road 24, construction of the embodiment 1 is partially modified by allowing the height of the arcuate part 25 of the U-shaped circle road 24 to exceed the height of the connection platform 23, so that the combination of the upper and lower U-shaped circle roads 24 has a saddle-like shape. Thus, in order to shorten the length of the U-shaped circle road 24, vehicles will enter an up-ramp when traveling from the connection platform 23 onto the U-shaped circle road 24, and will enter a down-ramp when traveling from the U-shaped circle road 24 onto the connection platform 23.

Because vehicles enter an up-ramp after entering the entrance 18 of the U-shaped circle road 24, the speed of the vehicles is automatically reduced and the margin for safely turning the vehicle on the arcuate end 25 increased.

If there is no need to provide non-motor vehicle and pedestrian ways under the overpass then the arched separated bridge 2 can be constructed as a flat driveway, and accordingly the connection platform 23 can be provided on the ground, thereby avoiding the need for vehicles to enter the connection platform 23 and the ramp of the arched separated bridge 2. Raising the arcuate part 25 of the U-shaped circle road 24 to a certain height will ensure that the vehicles on the main road 1 pass under the arcuate part 25 of the U-shaped circle road thus allowing for a large reduction in the overall height of the overpass.

EXAMPLE 3

Figure 3:
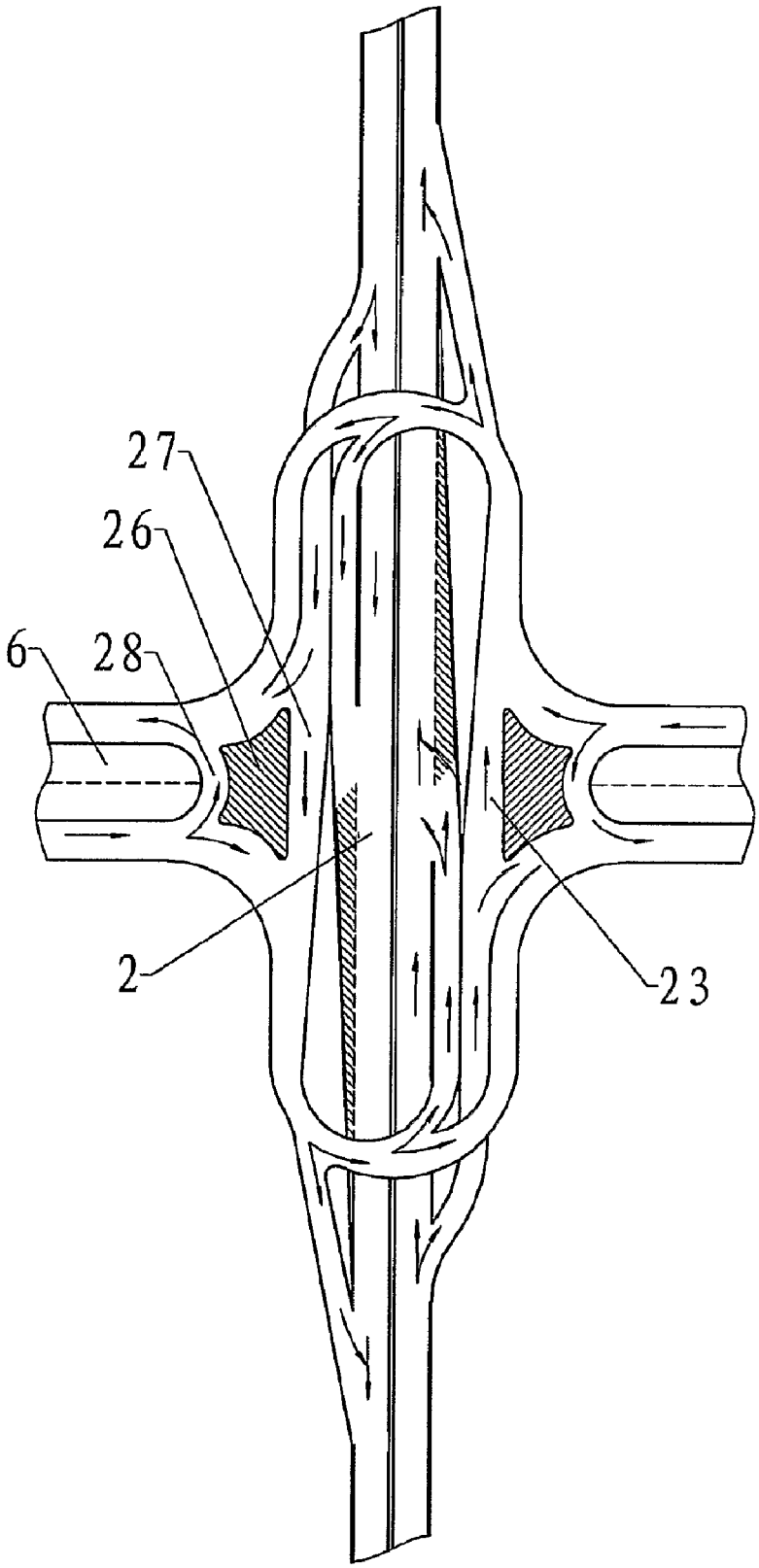
FIG. 3 is a plan view and directional scheme of another embodiment of the invention.

As shown in FIG. 3 in order to reduce the driving distance of vehicles turning around on the intersected road 3 in embodiments 1 and 2, medians 26 for turning around are provided on the left and right connection platforms 23, respectively. The median 26 for turning around separates the connection platform 23 into the straight transit driveway 27 between the upper and lower U-shaped circle roads 24 and the U-turn driveway 28, which not only ensures a straight-way driving between the upper and lower U-shaped circle roads 24, but also allows vehicles turning around on the intersected road 3 to enter the on-ramp through the U-turn driveway 28 directly after entering the connection platform 23 from the off-ramp, thus decreasing the turnaround distance on the U-shaped circle road 24.

If the topographic condition permits or if there is a need to expand capacity, an underpass tunnel 6 in the direction of the left and right intersected road 3 can be added beneath the walking way surface extending through the main road 1. By doing so, the straight-driving vehicle from left to right or vice versa don't need to travel around the connection platform 23 and the U-shaped circle road 24, and as a result vehicles can be driven faster and more conveniently, to meet the larger traffic flow. If there is no need to consider the pedestrian and non-motor vehicle ways under the overpass, such as in the highways and suburbs, then the underpass tunnel 6 can be constructed as a semi-sinking underpass tunnel passing the arched separated bridge 2 resulting in a reduction of construction costs and improvement in ventilation and in water-removal from the tunnel. Alternatively, it is also possible to provide the overhead bridge passing through the upper side of the connection platform 23 and the arched separated bridge 2 between the left and right intersected roads 3. Therefore the vehicles on the intersected road 3 can travel straight-though, thus enabling the overpass to be constructed by several periods and added with one more layer of single span bridge to form another main road.

EXAMPLE 4

Figure 4:
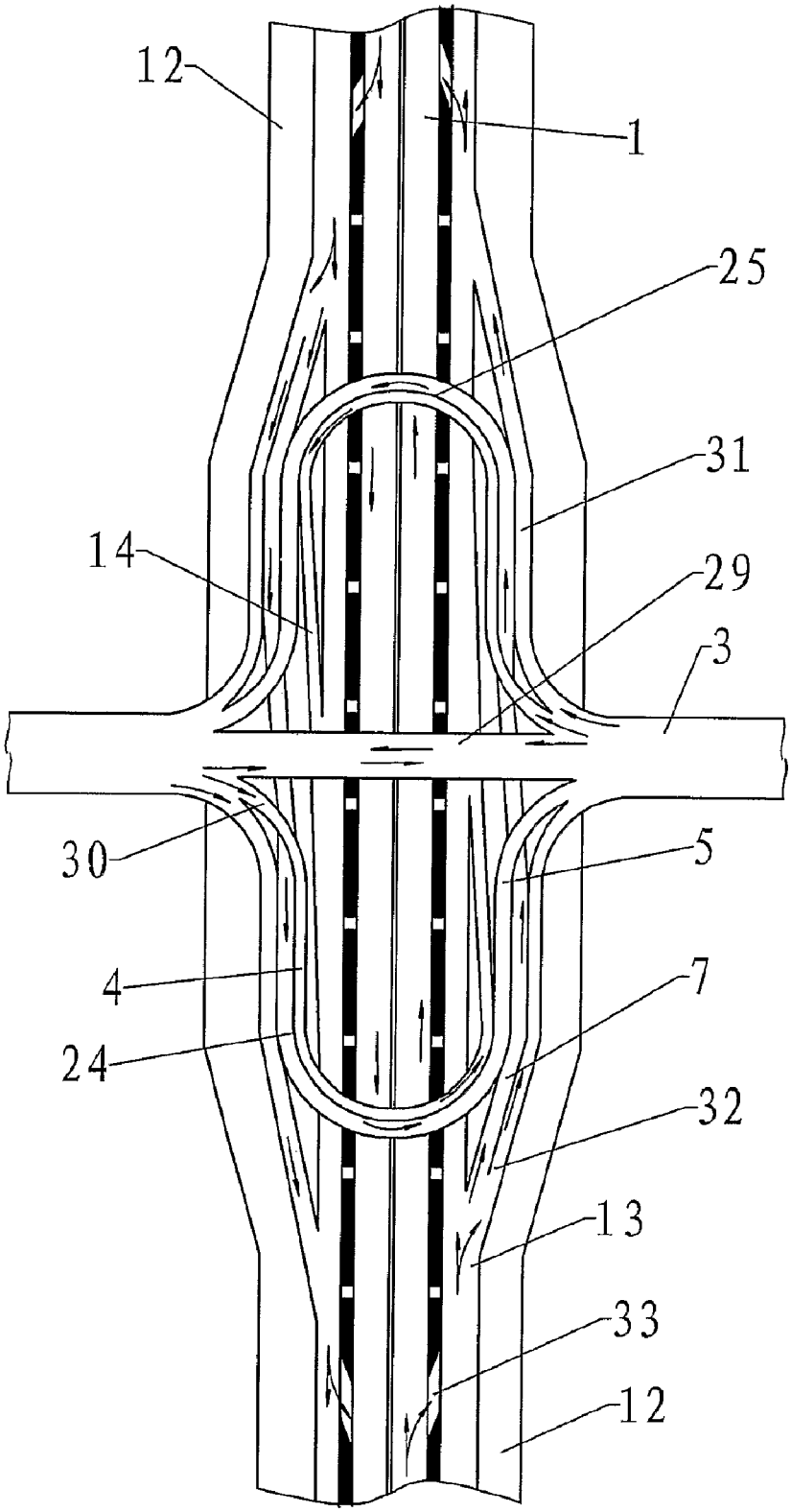
FIG. 4. is a plan view and directional scheme of yet another embodiment of the invention.

As shown in FIG. 4, the overpass of the embodiment is suitable for use in highways and expressways. A level driveway is provided between the upper and lower sides of the main road 1 while at both sides of the main road 1 a secondary road 13 parallel with the main road 1 is provided. The outer pass way 33 connects the main road 1 and the secondary road 13. The overhead bridge 29 passing above across the main road 1 is provided between the left and right sides of the intersected road 3.

The U-shaped circle roads 24 are provided at the horizontal level at both the upper and lower sides of the main road 1. The U-shaped circle roads 24 include the inner semicircle roads 4 and the outer semi circle roads 5. The branch common road 7 is provided on the secondary road 13 connected with the off-ramp of the main road 1. The lower common road 7 is connected with the entrance of the outer semicircle road 5 of the upper U-shaped circle road 24 after passing through under the overhead bridge 29, while the upper common road 7 is connected with the entrance of the outer semicircle road 5 of the lower U-shaped circle road 24 after passing through under the overhead bridge 29. The outer semicircle road 5 is connected with the on-ramp of the overhead bridge 29 after passing across the arcuate end 25 of the main road. The left turn branch lane 30 is connected with the on-ramp of the inner semicircle road 4 from the off-ramp of the overhead bridge 29 on the intersected road 3 while the inner semi circle road 4 is connected with the on-ramp of the secondary road 13 through the left turn driveway 14 after passing across under the arcuate end 25 of the main road.

The right turn branch lane 31 is provided between the overhead bridge 29 and the secondary road 13 connected with the on-ramp of the main road. The right turn branch lane 31 is connected with the secondary road 13 through the lower ramp. The right turn road 32 is provided on the secondary road 13 connected with the off-ramp of the main road 1. The right turn road 32 is connected with the on-ramp of the overhead bridge 29 through the upper ramp. The pavement and non-motor vehicle way 12 are provided on the outer side of the secondary road 13.

Below the driving directions of the vehicles on the overpass will be described with connection to the arrows in FIG. 4 indicating the driving direction of the vehicles. (1) Straight through from the lower side to the upper side: the vehicles travel straight-ahead to the upper part of the road along the lower part of the main road 1. (2) Straight through from the left to right: the vehicles travel straight to the right part of the road from the left part of the road of the overhead bridge 29 on the intersected road 3. (3) Turn from the lower main road 1 onto the right intersected road 3: the vehicles enter the secondary road 13 through the outer pass way 33 from the off-ramp of the main road 1, and then from the right turn road 32 connected with the secondary road 13 turn right by the upper ramp entering the on-ramp of the overhead bridge 29 of the intersected road 3. (4) Turn from the lower main road 1 onto the left intersected road 3: the vehicles enter the secondary road 13 through the outer pass way 33 from the off-ramp of the main road 1, and then from the common road 7 connected with the secondary road 13 enter the on-ramp of the U-shaped circle road 24 after passing under through the overhead bridge 29, then after entering the outer semicircle road 5 through the arcuate end 25 enter the on-ramp of the overhead bridge 29. (5) Turn from the left intersected road 3 onto the lower main road 1: the vehicles enter the on-ramp of the main road via the lower ramp of the right turn branch lane 31 of the over head bridge 29. (6) Turn from the left intersected road 3 onto the upper main road 1: the vehicles enter from the off-ramp of the overhead bridge 29 on the intersected road 3 onto the on-ramp of the inner semicircle road 4 through the left turn branch lane 30, and then enter the secondary road 13 after passing through the left turn road 14 by the lower ramp of the arcuate end 25, then enter the on-ramp of the main road 1 through the outer pass way 33.

Since the height of the overpass of the embodiment is the height of the overhead bridge 29 or the arcuate end 25 of the U-shaped circle road 24, the overpass belongs to a single laver type. The transfer of the vehicles on the overpass will not cause any inference.

It should be noted that while the foregoing description is aimed to illustrate the principle of the invention, those skilled in the art will appreciate that certain variations and modifications of the basic embodiments are possible.

Therefore, the invention is not limited by any particular construction of the embodiments, and all of the modifications are within the scope of the invention.

The invention claimed is:

1. An interchange overpass comprising a main road (1);

an intersected road (3);

one or more U-shaped semi-circular roads (24) each having an inner semi-circle road (4) and an outer semi-circle road (5);

one or more connection platforms (23);

one or more right on-ramps (9); and one or more common roads (7);

wherein said main road (1) is connected to said U-shaped semi-circular roads (24) by said right on-ramps (9), said common roads (7), and optionally said inner semi-circle road (4);

said intersected road (3) is connected to said U-shaped semi-circular roads (24) by said connection platforms (23); and said connection platforms (23) are connected to said U-shaped semi-circular roads (24) and said common roads (7).

2. The interchange overpass of claim 1, wherein said common road (7) is disposed between said inner semi-circle road (4) and said outer semi-circle road (5).

3. The interchange overpass of claim 1, wherein said common road (7) passes under said outer semi-circle road (5).

4. The interchange overpass of claim 1, wherein said main road (1) comprises an arched separated bridge (2).

5. The interchange overpass of claim 4, wherein said intersected road (3) comprises one or more semi-ramped overhead bridge stages (8).

6. The interchange overpass of claim 5, wherein said arched separated bridge (2) in connected to said semi-ramped overhead bridge stage (8) by said connection platform (23).

7. The interchange overpass of claim 4, wherein said arched separated bridge (2) has a road surface and said the connection platform (23) has a road surface, and said road surface of said arched separated bridge (2) and said road surface of said connection platform (23) are at about the same relative height with respect to each other.

8. The interchange overpass of claim 4, wherein said arched separated bridge (2) has a road surface and said U-shaped semi-circular roads (24) have a road surface, and said road surface of said arched separated bridge (2) and said road surface of said U-shaped semi-circular roads (24) are at about the same relative height with respect to each other.

9. The interchange overpass of claim 1, wherein said U-shaped semi-circular roads (24) comprise further an arcuate end (25) having a road surface; said the connection platform (23) has a road surface; and said road surface of said arcuate end (25) is at a higher relative height than said road surface of said connection platform (23) with respect to each other.

10. The interchange overpass of claim 4, comprising further a convergent secondary road (17), wherein said convergent secondary road (17) is provided at an intersection of said inner semicircle road (4) and said arched separated bridge (2).

11. The interchange overpass of claim 1 comprising further an underpass tunnel (6), wherein said intersected road (3) is disposed within said underpass tunnel (6).

12. The interchange overpass of claim 1 comprising further an overhead bridge, wherein said intersected road (3) is disposed on top of said overhead bridge.

13. The interchange overpass of claim 1 comprising further one or more U-turn driveways (28) allowing for a direct U-turn on said intersected road (3).

14. The interchange overpass of claim 1 comprising further a right turn branch lane (31) and a right turn road (32), wherein said right turn branch lane (31) is not directly connected to said U-shaped semi-circular roads (24), said right turn branch lane (31) connects said main road (1) to said intersected road (3), said right turn road (32) is not directly connected to said U-shaped semi-circular roads (24), and said right turn road (32) connects said intersected road (3) to said main road (1).

15. The interchange overpass of claim 4, wherein vehicles traveling straight through said main road (1) travel on the arched separated bridge (2) underneath said arcuate part (25).

16. The interchange overpass of claim 5, wherein vehicles traveling straight through said intersected road (3) travel through said semi-ramped overhead bridge stage (8) onto said connection platform (23), then enter said U-shaped circle road (24), then enter said outer semi-circle road (5), then enter said connection platform (23), then travel though said semi-ramped overhead bridge stage (8) continuing onto said intersected road (3).

17. The interchange overpass of claim 5, wherein vehicles turning from said main road (1) onto said intersected road (3) enter said common road (7), then enter said connection platform (23), then turn right entering said semi-ramped over head bridge stage (8), and continue onto said intersected road (3).

* * * * *